US011810691B2

(12) United States Patent
Kureishi et al.

(10) Patent No.: US 11,810,691 B2
(45) Date of Patent: Nov. 7, 2023

(54) ALUMINUM BASE WIRE

(71) Applicant: SUMITOMO ELECTRIC INDUSTRIES, LTD., Osaka (JP)

(72) Inventors: Yusuke Kureishi, Osaka (JP); Akihisa Hosoe, Osaka (JP); Kengo Goto, Osaka (JP); Yoshimasa Shirai, Osaka (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 307 days.

(21) Appl. No.: 17/434,477

(22) PCT Filed: Mar. 17, 2020

(86) PCT No.: PCT/JP2020/011822
§ 371 (c)(1),
(2) Date: Aug. 27, 2021

(87) PCT Pub. No.: WO2020/189689
PCT Pub. Date: Sep. 24, 2020

(65) Prior Publication Data

US 2022/0139593 A1 May 5, 2022

(30) Foreign Application Priority Data

Mar. 20, 2019 (JP) ..... 2019-053850

(51) Int. Cl.
*C22C 13/00* (2006.01)
*H01B 5/02* (2006.01)
(Continued)

(52) U.S. Cl.
CPC ..... *H01B 5/02* (2013.01); *C22C 13/00* (2013.01); *C25D 5/12* (2013.01); *C25D 7/06* (2013.01)

(58) Field of Classification Search
CPC ..... H01B 5/02; C22C 13/00; C22C 18/00; C22C 21/00; C25D 5/12
See application file for complete search history.

(56) References Cited

U.S. PATENT DOCUMENTS 3,915,667 A * 10/1975 Ricks ..... C25D 5/12 205/213
6,178,623 B1 * 1/2001 Kitazawa ..... H01L 24/45 205/176
(Continued)

FOREIGN PATENT DOCUMENTS

JP 50-057036 A 5/1975
JP 54-144992 A 11/1979
(Continued)

OTHER PUBLICATIONS

International Search Report for corresponding Application No. PCT/JP2020/011822, dated Jun. 23, 2020.

*Primary Examiner* — Sherman Ng
(74) *Attorney, Agent, or Firm* — Renner, Otto, Boisselle & Sklar, LLP

(57) ABSTRACT

An aluminum base wire includes a core wire made of pure aluminum or an aluminum alloy and a coating layer provided on an outer periphery of the core wire. The coating layer includes a first layer provided on the outer periphery of the core wire, a second layer provided on an outer periphery of the first layer, and a third layer provided on an outer periphery of the second layer. The first layer is composed of at least one metal selected from the group consisting of nickel, a nickel alloy, copper, and a copper alloy, the second layer is composed of metals that include zinc and tin, the third layer is composed of at least one metal selected from the group consisting of tin and tin alloys that contain
(Continued)

substantially no zinc, and a zinc content in the second layer is 15 atomic % or more and 60 atomic % or less.

8 Claims, 6 Drawing Sheets

(51) Int. Cl.
*C25D 5/12* (2006.01)
*C25D 7/06* (2006.01)

(56) References Cited

U.S. PATENT DOCUMENTS

2006/0102368 A1* 5/2006 Michel épouse Allaire et al. ..... H01B 13/02 174/36
2006/0283621 A1* 12/2006 Debladis ..... H01B 1/023 174/128.1

FOREIGN PATENT DOCUMENTS

JP 2006-219736 A 8/2006
JP 2010-157416 A 7/2010
JP 2013-007092 A 1/2013

* cited by examiner

ALUMINUM BASE WIRE

TECHNICAL FIELD

The present disclosure relates to an aluminum base wire.

The present application claims the benefit of priority based on Japanese Patent Application No. 2019-053850 filed on Mar. 20, 2019, which is incorporated herein by reference in its entirety.

BACKGROUND ART

An aluminum alloy wire disclosed in Patent Document 1 includes a coating layer covering an outer periphery of an alloy wire. The coating layer has an intermediate layer formed on the alloy wire side and an outermost layer formed on the outermost side. The intermediate layer has a one-layer structure or a two-layer structure. Each layer is composed of nickel or copper. The outermost layer is composed of tin or a tin alloy. Hereinafter, the alloy wire will be referred to as a "core wire".

CITATION LIST

Patent Documents

Patent Document 1: JP 2010-157416A

SUMMARY OF INVENTION

An aluminum base wire according to the present disclosure includes:

a core wire made of pure aluminum or an aluminum alloy; and a coating layer provided on an outer periphery of the core wire;

in which the coating layer includes a first layer provided on the outer periphery of the core wire, a second layer provided on an outer periphery of the first layer, and a third layer provided on an outer periphery of the second layer, the first layer is composed of at least one metal selected from the group consisting of nickel, iron, cobalt, chromium, copper, silver, and alloys of these elements, the second layer is composed of metals that include zinc and tin, the third layer is composed of at least one metal selected from the group consisting of tin and tin alloys that contain substantially no zinc, and a zinc content in the second layer is 15 atomic % or more and 60 atomic % or less.

DESCRIPTION OF EMBODIMENTS

Figure 1:
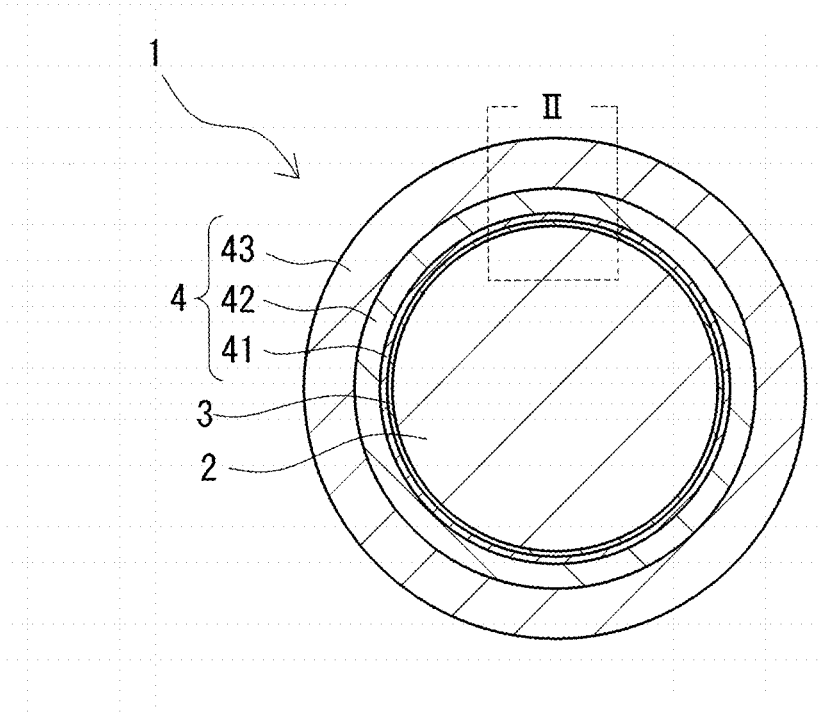
FIG. 1 is a cross-sectional view showing an overview of an aluminum base wire according to Embodiment 1.

Problem to be Solved by the Present Disclosure

The core wire, the intermediate layer, and the outermost layer are composed of different types of metals. When the intermediate layer is composed of nickel or copper, the potential difference between the core wire and the intermediate layer is larger than the potential difference between the intermediate layer and the outermost layer. Therefore, when moisture adheres to a portion of contact between different types of metals through pin holes or the like extending from a surface of the coating layer to a surface of the core wire, the peripheral surface of the core wire is corroded. This corrosion is called galvanic corrosion. It is conceivable to increase the thickness of the coating layer in order to decrease the formation of pinholes. However, even if the thickness of the coating layer is increased, corrosion of an end surface of the core wire is not decrease. This is because, when using an aluminum wire, if it is cut to a predetermined length, the end surfaces of the core wire and the coating layer are exposed. Also, an aluminum wire provided with a thick coating layer has low workability.

In view of this, an object of the present disclosure is to provide an aluminum base wire provided with a core wire having both corrosion resistance and workability. Also, another object of the present disclosure is to provide an aluminum base wire in which an end surface of the core wire has high corrosion resistance.

Advantageous Effects of the Present Disclosure

An aluminum base wire according to the present disclosure has high corrosion resistance of a core wire and high workability.

Description of Embodiments of the Present Disclosure

First, embodiments of the present disclosure will be described below.

(1) An aluminum base wire according to an aspect of the present disclosure includes:

a core wire made of pure aluminum or an aluminum alloy; and a coating layer provided on an outer periphery of the core wire;

in which the coating layer includes a first layer provided on the outer periphery of the core wire, a second layer provided on an outer periphery of the first layer, and a third layer provided on an outer periphery of the second layer, the first layer is composed of at least one metal selected from the group consisting of nickel, iron, cobalt, chromium, copper, silver, and alloys of these elements, the second layer is composed of metals that include zinc and tin, the third layer is composed of at least one metal selected from the group consisting of tin and tin alloys that contain substantially no zinc, and a zinc content in the second layer is 15 atomic % or more and 60 atomic % or less.

With the above-described configuration, the aluminum base wire has high corrosion resistance of the core wire and high workability. With the above-described configuration, it has high bendability, in particular. The reason why the core wire has high corrosion resistance is that corrosion of the core wire can be decrease due to the second layer functioning as a sacrificial layer that is preferentially corroded over the core wire. Because the zinc content in the second layer is 15 atomic % or more, the second layer contains a large amount of zinc. Therefore, the potential difference between the first layer and second layer is larger than the potential difference between the core wire and the first layer. Thus, even if moisture adheres to a portion of contact between different types of metals of the core wire and the coating layer through pinholes or the like extending from the surface of the coating layer to the surface of the core wire, or even if moisture adheres to a portion of contact between different types of metals on a cross-section of the aluminum base wire, the second layer corrodes instead of the core wire. Also, the third layer contains substantially no zinc, and thus is not preferentially corroded. On the other hand, the reason for high workability is that the second layer can prevent hardening of the coating layer because the zinc content is not excessively high due to the zinc content in the second layer being 60 atomic % or less, and the second layer is not excessively hard. Hereinafter, an aluminum base wire may be referred to as an "Al base wire".

Also, with the above-described configuration, adhesion between the core wire and the coating layer is improved. This is because the first layer has good compatibility with both the core wire and the second layer.

Furthermore, the above-described configuration can decrease contact resistance with the following terminal member with ease in applications in which an Al base wire is connected thereto. Examples of the terminal member include a terminal member made of copper or a copper alloy, and a terminal member provided with a main body portion made of copper or a copper alloy and a Sn layer formed on the surface of the main body portion. Examples of the Sn layer include a Sn plating layer. The reason why the contact resistance can be decreased with ease is that a surface of the Al base wire that is in contact with the terminal member is composed of the third layer that is composed of a tin-based metal. If a large amount of zinc is present on the contact surface side of the Al base wire that is in contact with the terminal member, the contact resistance between the Al base wire and the terminal member increases. However, it is possible to prevent the second layer and the terminal member from being connected to each other because the coating layer has the third layer formed on the second layer that contains a large amount of zinc.

(2) As an embodiment of the aluminum base wire, a structure of the second layer has a dispersion structure in which second phases, which contain zinc as a main component, are dispersed in a first phase, which contains tin as a main component, and the second phase has a size of 0.01 μm or more and 1 μm or less.

When the size of the second phase is 0.01 μm or more, the core wire of the Al base wire has high corrosion resistance. The reason therefor is that the second layer is likely to function as the sacrificial layer because the second phase has a sufficient size. In addition, the Al base wire has high workability. The reason therefor is that the second layer is not excessively hard because the second phase has a sufficient size. When the size of the second phase is 1 μm or less, the core wire of the Al base wire has high corrosion resistance. The reason therefor is that the second phase is unlikely to be sparse.

(3) As an embodiment of the aluminum base wire, a ratio D2/D1 between a thickness D1 of the first layer and a thickness D2 of the second layer is 5 or more.

With the above-described configuration, the corrosion of the core wire is likely to be decreased. The reason therefor is that the second layer is preferentially corroded over the core wire because the thickness D2 of the second layer is sufficiently larger than the thickness D1 of the first layer.

(4) As an embodiment of the aluminum base wire, the first layer has a thickness D1 of 0.05 μm or more and 1 μm or less.

The core wire of the Al base wire whose first layer has a thickness D1 of 0.05 μm or more has high corrosion resistance because the thickness D1 of the first layer is sufficiently large. The Al base wire whose first layer has a thickness D1 of 1 μm or less has high workability because the thickness D1 of the first layer is not excessively large.

(5) As an embodiment of the aluminum base wire, the second layer has a thickness D2 of 0.5 μm or more.

With the above-described configuration, the core wire has high corrosion resistance because the thickness D2 of the second layer is sufficiently large.

(6) As an embodiment of the aluminum base wire, the third layer has a thickness D3 of 1.5 μm or more.

With the above-described configuration, an increase in the contact resistance with a terminal member is likely to be prevented. The reason therefor is that zinc is unlikely to diffuse to the surface of the third layer because the thickness D3 of the third layer is sufficiently large. In addition, with the above-described configuration, the formation of pinholes is likely to be decreased. The reason therefor is that the thickness D3 of the third layer is sufficiently large. Therefore, the amount of corrosion of the second layer is reduced and the service life of the Al base wire is extended.

(7) As an embodiment of the aluminum base wire, the core wire has a diameter of 0.01 μm or more and 2 mm or less.

The above-described configuration can be easily used for various applications.

(8) As an embodiment of the aluminum base wire, the aluminum base wire further includes a base layer provided between the core wire and the coating layer, and the base layer contains zinc as a main component.

With the above-described configuration, the adhesion between the core wire and the first layer is improved. This is because the base layer is likely to be fit to both the core wire and the first layer.

DETAILS OF EMBODIMENTS OF THE PRESENT DISCLOSURE

Embodiments of the present disclosure will be described in detail below. The same reference numerals in the drawings indicate objects having the same names.

Embodiment 1

Aluminum Base Wire

Figure 2:
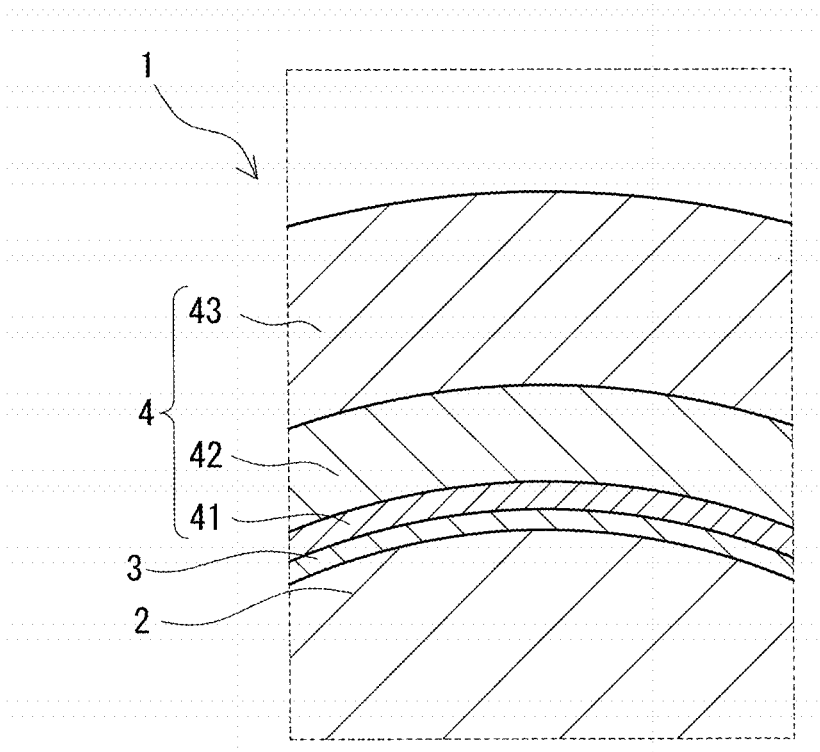
FIG. 2 is an enlarged view of a region of the aluminum base wire shown in FIG. 1 surrounded by a dashed rectangular frame.
Figure 4:
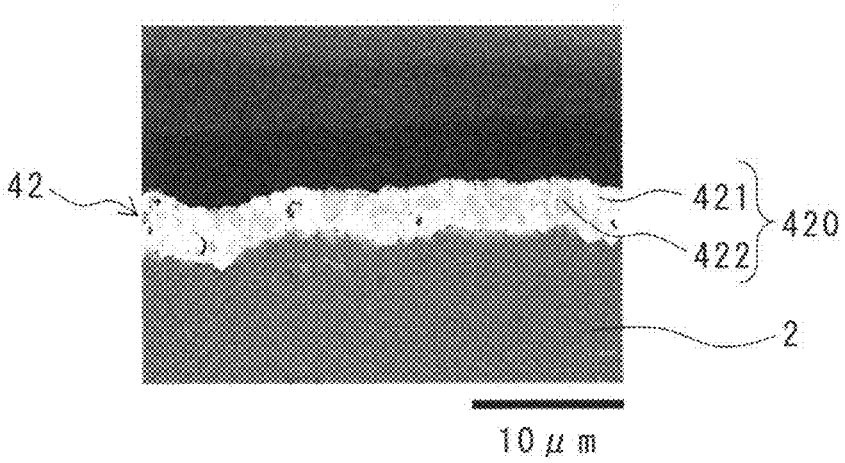
FIG. 4 is a microphotograph showing a cross-section of a second layer provided in an aluminum base wire of Sample No. 6.

An aluminum base wire 1 according to Embodiment 1 will be described with reference to FIGS. 1 and 2. FIG. 4 may also be referred to as appropriate. Hereinafter, the aluminum base wire 1 will be referred to as "Al base wire 1". The Al base wire 1 includes a core wire 2 made of pure aluminum (Al) and an Al alloy, and a coating layer 4 covering an outer periphery of the core wire 2. The coating layer 4 has a multilayer structure having a first layer 41, a second layer 42, and a third layer 43 in the stated order from the core wire 2 side. One of the characteristics of the Al base wire 1 is that the second layer 42 is composed of a specific material. An example in which the Al base wire 1 includes a base layer 3 interposed between the core wire 2 and the coating layer 4 will be described below. The following describes each constituent element thereof in detail.

Core Wire

The core wire 2 is composed of pure Al or an Al alloy. Examples of the Al alloy include Al alloys that contain additive elements and have various compositions in which the remaining portion includes Al and inevitable impurities.

The additive element may be at least one element selected from the group consisting of iron (Fe), magnesium (Mg), silicon (Si), copper (Cu), zinc (Zn), nickel (Ni), manganese (Mn), silver (Ag), chromium (Cr), and zirconium (Zr), for example. These additive elements may be elements of only one type or a combination of two or more types. Examples of such an alloy include Al—Fe alloys, Al—Fe—Mg alloys, Al—Fe—Si alloys, Al—Fe—Mg—(Mn, Ni, Zr, Ag) alloys, Al—Fe—Cu alloys, Al—Fe—Cu—(Mg, Si) alloys, and Al—Mg—Si—Cu alloys. The total content of the additive elements is preferably 0.005 mass % or more and 5.0 mass % or less, and more preferably 0.1 mass % or more and 2.0 mass % or less. The preferred content of each additive element is as follows. The Fe content is preferably 0.005 mass % or more and 2.2 mass % or less. The Mg content is preferably 0.05 mass % or more and 1.0 mass % or less. The Si content is preferably 0.04 mass % or more and 1.0 mass % or less. The Cu content is preferably 0.05 mass % or more and 0.5 mass % or less. The total content of Zn, Ni, Mn, Ag, Cr, and Zr is preferably 0.005 mass % or more and 0.2 mass % or less.

The composition of the core wire 2 can be obtained through high frequency inductively coupled plasma optical emission spectrometry (ICP-OES). Specifically, the composition of the core wire 2 can be obtained using iCAP6500 manufactured by Thermo Fisher Scientific.

The diameter of the core wire 2 is preferably 0.01 mm or more and 2 mm or less, for example, although it depends on applications of the Al base wire 1 and the like. The diameter refers to the diameter of the core wire 2, which is a single wire. The core wire 2 whose diameter satisfies the above-described range can be easily used for various applications. The diameter of the core wire 2 can be obtained through cross-sectional observation using a scanning electron microscope (SEM). First, four or more transverse sections of the Al base wire 1 are obtained. A transverse section refers to a cross-section that is orthogonal to the longitudinal direction of the Al base wire 1. The area of the core wire 2 on each transverse section is obtained. The area of the core wire 2 can be obtained using image analysis software. The boundary between the core wire 2 and the base layer 3, or the boundary between the core wire 2 and the coating layer 4 can be identified because interfaces are formed. The average of the equivalent diameters of equal-area circles obtained by converting each area into the area of a complete round is obtained. This average is used as the diameter of the core wire 2.

Base Layer

The base layer 3 improves the adhesion between the core wire 2 and the coating layer 4. The base layer 3 is a metal layer provided directly on the core wire 2 over the entire outer periphery of the core wire 2. Although the Al base wire 1 of this embodiment is provided with the base layer 3, this base layer 3 need not be provided.

The base layer 3 contains Zn as the main component. The base layer 3, which contains Zn as the main component, is likely to improve the adhesion between the core wire 2 and the first layer 41. The main component means that the Zn content satisfies 60 atomic % or more when the content of all of the constituent elements of the base layer 3 is 100 atomic %. The Zn content is more preferably 75 atomic % or more, and particularly preferably 80 atomic % or more. The base layer 3 may be composed of substantially only Zn. "Being composed of substantially only Zn" refers to allowing inclusion of inevitable impurities other than Zn. The material of the base layer 3 can be determined through energy-dispersive X-ray analysis (EDX) using a scanning transmission electron microscope (STEM) on a cross-section of the Al base wire 1 that has been processed with a focused ion beam (FIB), for example.

The base layer 3 has a thickness D0 of 5 nm or more and 100 nm or less, for example. When the thickness D0 of the base layer 3 is 5 nm or more, the base layer 3 can improve the adhesion between the core wire 2 and the coating layer 4. When the thickness D0 of the base layer 3 is 100 nm or less, the Al base wire 1 has high workability. The reason therefor is that the base layer 3 is not excessively thick. The thickness D0 of the base layer 3 is preferably 8 nm or more and 50 nm or less, and particularly preferably 10 nm or more and 30 nm or less.

Coating Layer

The coating layer 4 covers the outer periphery of the core wire 2 and chemically protects the core wire 2. The coating layer 4 has a multilayer structure having the first layer 41, the second layer 42, and the third layer 43 in the stated order from the core wire 2 side, that is, from the base layer 3 side in this embodiment. The thickness D0 of the base layer 3 and the thicknesses D1 to D3 of the first layer 41 to the third layer 43 of the coating layer 4 in FIG. 2 are schematically, and do not necessarily correspond to the actual thicknesses.

First Layer

The first layer 41 is a metal layer provided on the innermost side of the coating layer 4, that is, directly on the base layer 3 over the entire outer periphery of the base layer 3. This first layer 41 increases the adhesion between the second layer 42 and the core wire 2, or the adhesion between the second layer 42 and the base layer 3.

The material of the first layer 41 is at least one metal selected from the group consisting of Ni, Fe, Co (cobalt), Cr, Cu, Ag, and alloys of these elements. Examples of the above-described alloys include Ni—Fe alloys, Ni—Co alloys, Ni—Sn alloys, Ni—Cu alloys, Fe—Co alloys, Ag—Sn alloys, and Cu—Sn alloys. It is preferable that the Zn content in the above-described alloy is low, and the Zn content is preferably an amount contained therein as inevitable impurities. This first layer 41 does not serve as a sacrificial layer such as the second layer 42, which will be described later. The composition of the first layer 41 can be obtained using a method that is similar to the above-described method for obtaining the composition of the core wire 2. The same applies to the material of the second layer 42 and the material of the third layer 43, which will be described later.

The first layer 41 preferably has a thickness D1 of 0.05 μm or more and 1 μm or less. When the thickness D1 of the first layer 41 is 0.05 μm or more, the core wire 2 of the Al base wire 1 has high corrosion resistance. The reason therefor is that the thickness D1 of the first layer 41 is sufficiently large. When the thickness D1 of the first 41 layer is 1 μm or less, the Al base wire 1 has high workability. The reason therefor is that the thickness D1 of the first layer 41 is not excessively thick. Although the thickness D1 of the first layer 41 depends on the material thereof, when the material thereof is Ni, the thickness D1 of the first layer 41 is more preferably 0.075 μm or more and 0.5 μm or less, and particularly preferably 0.075 μm or more and 0.2 μm or less. A method for obtaining the thickness D1 of the first layer 41 will be described later together with the thickness D2 of the second layer 42, which will be described later, and the thickness D3 of the third layer 43, which will be described later.

Second Layer

The second layer 42 is a metal layer provided directly on the first layer 41 over the entire outer periphery of the first layer 41. The second layer 42 is a sacrificial layer that is preferentially corroded over the core wire 2 in a corrosive environment of the Al base wire 1. Therefore, the second layer 42 can decrease corrosion of the core wire 2. The "corrosive environment" refers to a state where moisture has adhered to portions of contact between different types of metals of the core wire 2, the base layer 3, and the coating layer 4, and the like. The reason why moisture adheres to a portion of contact between different types of metals is that pinholes extending from the surface of the coating layer 4 to the surface of the core wire 2 are formed, an end surface or a cross-section of the Al base wire 1 is formed.

The material of the second layer 42 contains Zn and Sn. The Zn content in the second layer 42 is 15 atomic % or more and 60 atomic % or less when the content of all of the constituent elements of the second layer 42 is 100 atomic %. When the Zn content in the second layer 42 is 15 atomic % or more, the core wire 2 of the Al base wire 1 has high corrosion resistance. The reason therefor is that the second layer 42 is preferentially corroded over the core wire 2 in a corrosive environment. Because the Zn content in the second layer 42 is high, the potential difference between the first layer 41 and the second layer 42 is larger than the potential difference between the core wire 2 and the first layer 41. Therefore, corrosion of the core wire 2 is decreased. The "Zn content being 15 atomic % or more" means an overwhelmingly larger amount compared to a case where Zn is contained as inevitable impurities. When the Zn content in the second layer 42 is 60 atomic % or less, the core wire 2 of the Al base wire 1 has high corrosion resistance. Because the Zn content is not excessively high, the size of Zn particles is not increased excessively. Therefore, Zn is unlikely to be sparse. The Zn content in the second layer 42 is preferably 20 atomic % or more and 55 atomic % or less, more preferably 20 atomic % or more and 50 atomic % or less, and particularly preferably 20 atomic % or more and 45 atomic % or less. The Zn content in the second layer 42 may be 25 atomic % or more. The second layer 42 may be composed of substantially only Zn and Sn. "Being composed of substantially only Zn and Sn" refers to allowing inclusion of inevitable impurities other than Zn and Sn.

It is preferable that the thickness D2 of the second layer 42 is sufficiently large with respect to the thickness D1 of the first layer 41. The reason therefore is that, when the thickness D2 of the second layer 42 is sufficiently larger compared to the thickness D1 of the first layer 41, the second layer 42 is likely to sufficiently function as a sacrificial layer. It is preferable that a ratio D2/D1 between the thickness D2 of the second layer 42 and the thickness D1 of the first layer 41 is 5 or more, for example. The second layer 42 having the above-described ratio D2/D1 of 5 or more is sufficiently thick and is likely to function as a sacrificial layer. The ratio D2/D1 is more preferably 10 or more and particularly preferably 15 or more. The upper limit of the ratio D2/D1 is, but is not particularly limited to, 60 or less, for example. When the upper limit of the ratio D2/D1 is 60 or less, the second layer 42 is not excessively thick, and the first layer 41 is not excessively thin.

The second layer 42 preferably has a thickness D2 of 0.5 μm or more. When the thickness D2 of the second layer 42 is 0.5 μm or more, the second layer 42 is likely to sufficiently function as a sacrificial layer. The reason therefor is that the thickness D2 of the second layer 42 is sufficiently large. The thickness D2 of the second layer 42 is more preferably 2 μm or more and particularly preferably 3 μm or more. The upper limit of the thickness D2 of the second layer 42 is, but is not particularly limited to, 15 μm or less, for example. When the thickness of the second layer 42 is 15 μm or less, the second layer 42 is not excessively thick. Therefore, the productivity of the Al base wire 1 is high.

As shown in FIG. 4, the structure of the second layer 42 has a dispersion structure 420 in which second phases 422 are dispersed in a first phase 421. A gray portion on the lower side of the page surface of FIG. 4 is the core wire 2. A layer extending in the left-right direction of the page surface of FIG. 4 at the center in the up-down direction of the page surface is the second layer 42. A white portion of the second layer 42 is the first phase 421, and light gray portions are the second phases 422. The second phases 422 are in the form of particles, and are dispersed in the first phase 421.

The first phase 421 contains Sn as the main component. "Containing Sn as the main component" means that the Sn content satisfies 60 atomic % or more when the content of all of the constituent elements of the first phase 421 is 100 atomic %. The Sn content in the first phase 421 is more preferably 70 atomic % or more, and particularly preferably 85 atomic % or more. The first phase 421 may be composed of substantially only Sn. "Being composed of substantially only Sn" refers to allowing inclusion of inevitable impurities other than Sn.

On the other hand, the second phases 422 contain Zn as the main component. "Containing Zn as the main component" means that the Zn content satisfies 60 atomic % or more when the content of all of the constituent elements of the second phase 422 is 100 atomic %. The Zn content in the second phase 422 is more preferably 70 atomic % or more, and particularly preferably 85 atomic % or more. Similarly to the first phase 421, the second phases 422 may be composed of substantially only Zn. "Being composed of substantially only Zn" refers to allowing inclusion of inevitable impurities other than Zn.

The materials of the first phase 421 and the second phases 422 can be determined through EDX.

The second phases 422 preferably have a size of 0.01 μm or more and 1 μm or less, for example. When the size of the second phases 422 are 0.01 μm or more, the second layer 42 is likely to function as a sacrificial layer. The reason therefor is that the second phases 422 have sufficient sizes. Furthermore, the Al base wire 1 has high workability. The reason therefor is that the second layer 42 is not excessively hard because the second phases 422 have sufficient sizes. When the size of the second phases 422 is 1 μm or less, the core wire 2 of the Al base wire 1 has high corrosion resistance. The reason therefor is that the second phases 422 are unlikely to be sparse. The size of the second phases 422 is more preferably 0.02 μm or more and 0.8 μm or less, preferably 0.04 μm or more and 0.6 μm or less, and particularly preferably 0.5 μm or less. A method for obtaining the size of the second phases 422 will be described later.

Third Layer

The third layer 43 is a metal layer provided directly on the second layer 42 over the entire outer periphery of the second layer 42. The third layer 43 is located on the outermost side of the coating layer 4.

The material of the third layer 43 is at least one metal selected from the group consisting of Sn and Sn alloys. The Sn alloy contains substantially no Zn. "Containing substantially no Zn" refers to allowing inclusion of Zn as inevitable impurities. If an Sn alloy contains Zn as inevitable impurities, the Zn content is 5 atomic % or less, for example. That is, the content of Zn included in the third layer 43 as inevitable impurities is overwhelmingly lower than the Zn content in the second layer 42. Therefore, the third layer 43 does not serve as a sacrificial layer such as the second layer 42 that is preferentially corroded over the core wire 2. When the Al base wire 1 having this third layer 43 is used for applications in which it is connected to the following terminal member, the contact resistance with the terminal member can be easily decreased. The terminal member is not shown in the drawings. Examples of the terminal member include a terminal member made of Cu or a Cu alloy, and a terminal member that has a main body portion made of Cu or a Cu alloy and a Sn layer formed on the surface of the main body portion. An example of the Sn layer includes a Sn plating layer. If a large amount of Zn is present on the contact surface side of the Al base wire 1 that is in contact with the terminal member, the contact resistance between the Al base wire 1 and the terminal member increases. However, the coating layer 4 has the third layer 43 covering the second layer 42 that contains a large amount of Zn, and thus it is possible to prevent connection between the second layer 42 and the terminal member. Examples of the Sn alloys include Sn—Cu alloys, Sn—Ag—Cu alloys, and Sn—In alloys.

The third layer 43 preferably has a thickness D3 of 1.5 μm or more, for example. When the thickness D3 of the third layer 43 is 1.5 μm or more, an increase in the contact resistance with the terminal member is likely to be prevented. The reason therefor is that Zn is unlikely to diffuse to the surface thereof because the thickness D3 of the third layer 43 is sufficiently large. In addition, the formation of pinholes is likely to be decreased. The reason therefor is that the thickness D3 of the third layer 43 is sufficiently large. Therefore, the amount of corrosion of the second layer 42 is reduced and the service life of the Al base wire 1 is extended. The upper limit of the thickness D3 of the third layer 43 is, but is not particularly limited to, 50 μm or less, for example. The thickness D3 of the third layer 43 is 2 μm or more, more preferably 3 μm or more and 50 μm or less, and particularly preferably 5 μm or more and 30 μm or less.

Applications

The Al base wire 1 of this embodiment can be suitably used for single wires, stranded wires, compressed wires, insulated electric wires, and conductors of terminal-equipped electrical wires. A stranded wire is obtained by twisting multiple single wires together. A compressed wire is obtained through compression molding of a stranded wire. An insulated electric wire includes an insulating coating on an outer periphery of any of a single wire, a stranded wire, and a compressed wire. A terminal-equipped electrical wire includes a terminal member that is attached to any of an end portion of the stranded wire, an end portion of the compressed wire, and an end portion of the Al base wire that is exposed through local removal of an insulating coating of an insulated electric wire. As described above, examples of the terminal member include a terminal member made of Cu or a Cu alloy, and a terminal member that has a main body portion made of Cu or a Cu alloy and a Sn layer formed on the surface of the main body portion.

Effects

The core wire 2 of the Al base wire 1 of this embodiment has high corrosion resistance, and the Al base wire 1 has high workability. The reason why the core wire 2 has high corrosion resistance is that it is possible to decrease corrosion of the core wire 2 as a result of the second layer 42 of the coating layer 4 serving as a sacrificial layer that is preferentially corroded over the core wire 2. The reason why the Al base wire 1 has high workability is that the second layer 42 is not excessively hard and the coating layer 4 is not excessively hard.

Method for Manufacturing Al Base Wire

The Al base wire 1 can be manufactured using a method for manufacturing an Al base wire, the method including step S1 of forming the base layer 3 on the outer periphery of the core wire 2 and step S2 of forming the coating layer 4 on the outer periphery of the base layer 3.

Step S1

The base layer 3 can be formed through zincate treatment or double zincate treatment. Known conditions can be used as treatment conditions.

Step S2

The step of forming the coating layer 4 includes a step of forming the first layer 41, the second layer 42, and the third layer 43 on the outer periphery of the base layer 3 in the stated order. The first layer 41 to the third layer 43 can be formed through plating, vapor deposition, or the like. Examples of plating include electroplating, electroless plating, and hot dipping. Examples of vapor deposition include CVD (Chemical Vapor Deposition), and PVD (Physical Vapor Deposition). Known plating conditions can be used to form the first layer 41 and the third layer 43.

Although the formation of the second layer 42 depends on the type of plating liquid, the second layer 42 can be formed under the following plating conditions, for example. The Zn content in the second layer 42, the thickness D2 of the second layer 42, and the size of the second phases 422 included in the dispersion structure 420 in the second layer 42 can be changed by appropriately selecting plating conditions, for example. Examples of the plating conditions include temperature, current density, time, and concentration ratio of metal ions in a plating bath. The temperature is 10° C. or more and 40° C. or less, for example, and 15° C. or more and 35° C. or less, and in particular, 20° C. or more and 35° C. or less. The current density is 1 A/dm$^2$ or more and 10 A/dm$^2$ or less, for example, and 1.5 A/dm$^2$ or more and 6 A/dm$^2$ or less, and in particular, 2 A/dm$^2$ or more and 3 A/dm$^2$ or less. Although the processing time depends on current density, the processing time is 80 sec or more and 1200 sec or less, for example, and 100 sec or more and 900 sec or less, and in particular, 120 sec or more and 600 sec or less. The ratio of the Sn ion concentration to the Zn ion concentration (Sn ion concentration/Zn ion concentration), which is the metal ion concentration ratio in the plating bath, is 1.6 or more and 5 or less, for example, and 1.8 or more and 4 or less, and in particular 2 or more and 3 or less.

Effects

With the above-described method for manufacturing the Al base wire, the core wire 2 has high corrosion resistance, and the Al base wire 1 with high workability can be manufactured.

Embodiment 2

Aluminum Base Wire

Figure 3:
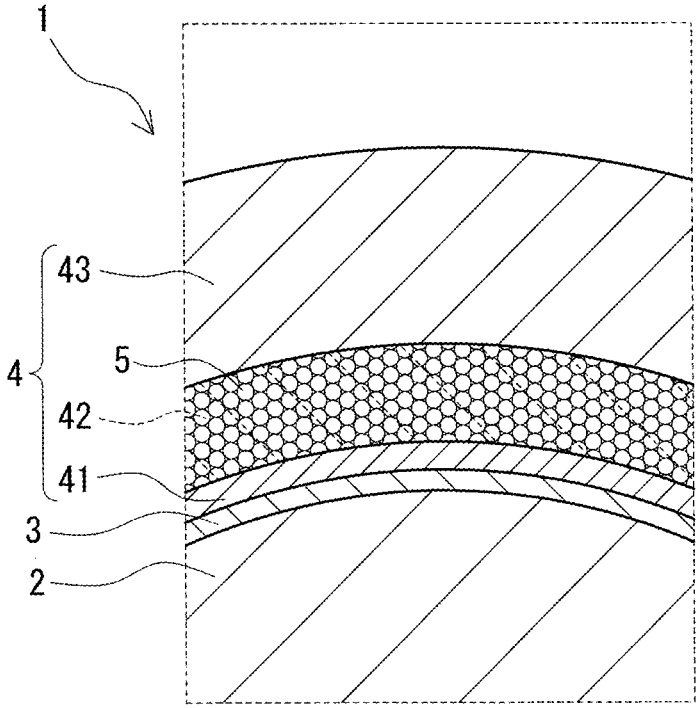
FIG. 3 is an enlarged view of a portion of a cross-section of the aluminum base wire according to Embodiment 2.

An Al base wire 1 according to Embodiment 2 will be described with reference to FIG. 3. The Al base wire 1 of this embodiment has an end surface where a core wire 2, a base layer 3, a first layer 41, a second layer 42, and a third layer 43 are exposed. This end surface can be produced by cutting the Al base wire 1 such that a transverse section thereof is formed. The Al base wire 1 is cut to an appropriate length as needed and the resulting Al base wire 1 is used. The Al base wire 1 of this embodiment is different from the Al base wire 1 of Embodiment 1 in that the end surface of the Al base wire 1 of this embodiment has a corrosion product 5 covering at least a portion of an end surface of the second layer 42. The following mainly describes the difference from Embodiment 1. Configurations that are the same as those of Embodiment 1 will not be described.

Corrosion Product

The corrosion product 5 is formed through corrosion of the second layer 42, which is a sacrificial layer, due to the end surface of the Al base wire 1 being placed in a corrosive environment. The corrosion product 5 contains Zn, which is contained in the second layer 42, as the main component. Because this corrosion product 5 is formed, the corrosion rate of the second layer 42 is likely to be reduced. The reason therefor is that it is conceivable that the formation of the corrosion product 5 is inhibited because the potential difference caused by bonding between different types of metals is reduced due to the first layer 41 being covered with the corrosion product 5. The corrosion product 5 is composed of oxides and/or hydroxides of Zn. The corrosion product 5 may be formed over the entire end surface of the second layer 42. Further, the corrosion product 5 may be formed to cover an end surface other than that of the second layer 42, or may be formed to cover the entire end surface of the Al base wire 1.

Effects

The Al base wire 1 of this embodiment exhibits effects that are similar to those of the Al base wire 1 of Embodiment 1, and the corrosion rate of the second layer 42 is likely to be reduced.

TEST EXAMPLE

An Al base wire was produced, and corrosion resistance of a core wire of the Al base wire, and the workability of the Al base wire were evaluated.

Sample No. 1 to Sample No. 18

The Al base wires of Sample No. 1 to Sample No. 18 were produced by forming a base layer directly on the core wire, and forming a coating layer directly on the base layer, the coating layer having a three-layer structure of a first layer, a second layer, and a third layer in the state order from the base layer side. A pure Al wire with a diameter of 0.5 mm and a length of 200 mm was used as the core wire. This pure Al wire corresponds to A1070 specified in "JIS H 4000 (2014), Aluminum and aluminum alloy sheets, strips and plates".

The base layer was formed in the order of degreasing, etching, desmutting, first zincate treatment, zinc stripping, and second zincate treatment.

SZ CLEANER manufactured by Kizai Corporation was used as treatment liquid in degreasing. "SZ CLEANER" is a product name. The liquid temperature was set to 70° C. The time for immersion in the liquid was set to 90 sec.

SZ ETCHANT manufactured by Kizai Corporation was used as treatment liquid in etching. "SZ ETCHANT" is a product name. The liquid temperature was set to 70° C. The time for immersion in the liquid was set to 90 sec.

An aqueous solution of nitric acid with a concentration of 50 mass % was used as a treatment liquid in desmutting. The liquid temperature was set to 25° C. The time for immersion in the liquid was set to 30 sec.

SZ-II manufactured by Kizai Corporation was used as treatment liquid in first zincate treatment. "SZ-II" is a product name. The liquid temperature was set to 20° C. The time for immersion in the liquid was set to 60 sec.

Zinc stripping was performed using the same treatment liquid under the same conditions as in desmutting.

Second zinc stripping was performed using the same treatment liquid under the same conditions as in the first zincate treatment.

The first to third layers were each formed through plating.

A Ni plating layer was formed as the first layer. A liquid containing nickel sulfamate hexahydrate (400 g/L), nickel chloride hexahydrate (10 g/L), and boric acid (40 g/L) was used as a plating liquid. The liquid temperature was set to 55° C. The time for immersion in the liquid was changed in various ways. The thickness D1 (μm) of the first layer was changed by changing the immersion time.

A plating layer made of Zn and Sn was formed as the second layer. SZ-240 manufactured by DIPSOL CHEMICALS Co., Ltd. was used as the plating liquid. "SZ-240" is a product name. The liquid temperature was set to 25° C. The time for immersion in the liquid was set to 120 sec. The current density and Sn ion concentration/Zn ion concentration in the plating bath were changed in various ways. The thickness D2 (μm), composition, and structure of the second layer were changed by changing the current density and the ion concentration ratio. Specifically, the Zn content (atomic %) was changed as a composition, and the size (μm) of the second phase was changed as a structure. Specific current density and ion concentration ratio are shown in Table. 1.

A Sn plating layer was formed as the third layer. A liquid containing stannous sulfate (40 g/L), potassium pyrophosphate (165 g/L), polyethylene glycol (1 g/L) with an average molecular weight of 3000, and 37-mass % formaldehyde (0.6 mL/L) was used as a plating liquid. The liquid temperature was set to 50° C. The time for immersion in the liquid was changed in various ways. The thickness D3 (μm) of the third layer was changed by changing the immersion time.

With regard to the obtained Al base wire, the thickness D1 of the first layer, the thickness D2 of the second layer, and the thickness D3 of the third layer were obtained. The results thereof are collectively shown in Table 1. The thicknesses D1 to D3 of the layers were obtained through cross-sectional observation using a SEM. First, a transverse section of the Al base wire was obtained. Four observation fields were obtained on the transverse section. The four observation fields were located at equal intervals in the circumferential direction of the Al base wire. In the case of the thickness D1 of the first layer, the magnification of each field and the size of each field were set such that the boundary between the first layer and the base layer and the boundary between the first layer and the second layer are included in the same field. Similarly, in the case of the thickness D2 of the second layer, the magnification and the size of each field were set such that the boundary between the second layer and the first layer and the boundary between the second layer and the third layer are included in the same field. In the case of the thickness D3 of the third layer, the magnification and the size of each field were set such that the boundary between the third layer and the second layer and the surface of the third layer are included in the same field. The length of each layer extending along the radial direction of the Al base wire was measured at four positions at equal intervals along the circumferential direction of the Al base wire in each observation field. The average of all of the measured lengths was obtained. The averages were used as the thicknesses D1 to D3 of the corresponding layers.

The structure of the second layer was observed using an SEM, and the composition of the second layer was analyzed through EDX. It was found that the second layers of the Al base wire of Sample No. 1 to Sample No. 18 each had a dispersion structure in which the second phases substantially made of Zn were dispersed in the first phase substantially made of Sn. FIG. 4 representatively shows a microphotograph of a transverse section of the Al base wire of Sample No. 6 before the third layer is formed. As described above, a gray portion on the lower side of the page surface of FIG. 4 indicates the core wire. A layer extending in the left-right direction of the page surface of FIG. 4 at the center in the up-down direction of the page surface is the second layer. A white portion of the second layer is the first phase, and a light gray portion is the second phase. As shown in FIG. 4, it is found that the second phases are dispersed in the first phase. The second phases are in the form of particles. Table 1 shows the Zn content in the second layers of the Al base wires of Sample No. 1 to Sample No. 18 as the results of analysis of the compositions of the second layers. The remaining portion of the second layer includes Sn and inevitable impurities. Also, the size of the second phase was obtained through cross-sectional observation using a SEM. Here, similarly to the above-described method for obtaining the thicknesses D1 to D3, four observation fields were obtained at equal intervals in the circumferential direction of the Al base wire. Each observation field was a rectangular region in which the second layer is included. The size of the rectangular region was set to 20 μm×2 μm. The area of all of the second phases included in all of the fields was obtained. The area of each second phase was obtained using image analysis software. The average of the equivalent diameters of equal-area circles obtained by converting each area into the area of a perfect circle was obtained. The obtained average was regarded as the size of the second phases. The results thereof are shown in Table 1.

Sample No. 19 and Sample No. 20

The Al base wire of Sample No. 19 was produced in the same manner as that of Sample No. 1 and the like, except that the second layer of the coating layer was manufactured under production conditions where the current density was set to 0.5 A/dm$^2$. The Al base wire of Sample No. 20 was produced in the same manner as that of Sample No. 1 and the like, except that the second layer of the coating layer was manufactured under production conditions where the current density was set to 6 A/dm$^2$ and the Sn ion concentration/Zn ion concentration was set to 1.5.

Samples No. 21 and No. 22

The Al base wire of Sample No. 21 is different from that of Sample No. 1 and the like mainly in that the coating layer has a one-layer structure including only the first layer. A Sn plating layer was formed as the coating layer. The type and the liquid temperature of the plating liquid were the same as those under the production conditions for the third layer of Sample No. 1. The thickness (μm) of the first layer was obtained in the same manner as that for Sample No. 1. The results thereof are shown in Table 1.

The Al base wire of Sample No. 22 is different from that of Sample No. 1 and the like mainly in that the coating layer has a two-layer structure including the first layer and the second layer. A Ni plating layer was formed as the first layer of the coating layer. The type and the liquid temperature of the plating liquid were the same as those under the production conditions for the first layer of Sample No. 1. A Sn plating layer was formed as the second layer of the coating layer. The type and the liquid temperature of the plating liquid were the same as those under the production conditions for the third layer of Sample No. 1. The thickness (μm) of the first layer and the thickness (μm) of the second layer were obtained in the same manner as that for Sample No. 1. The results thereof are shown in Table 1.

Evaluation of Corrosion Resistance

The corrosion resistance of the core wire of the Al base wire was evaluated by performing a salt spray test in accordance with "JIS Z 2371 (2000), Methods of salt spray testing", and examining the corrosion states of the outer peripheral surface and the end surface of the core wire.

The corrosion resistance of the outer peripheral surface of the core wire was evaluated as follows. A test piece with a length of 40 mm was produced by cutting the Al base wire along a direction orthogonal to the longitudinal direction thereof. An end surface of the test piece was masked with an adhesive so as not to be exposed. A salt spray test was performed on the test piece. An aqueous solution of 5-mass % sodium chloride was used in the salt spray test. The testing temperature was set to 35° C. (±2° C.). The testing time was set to 96 hours. Thereafter, corrosion products that did not adhere to the test piece were removed through ultrasonic washing. Then, the occurrence of pitting corrosion was checked. A test piece where no pitting corrosion occurred was evaluated as "5", a test piece where pitting corrosion occurred and fracture did not occur was evaluated as "3", and a test piece where pitting corrosion occurred and fracture occurred was evaluated as "1". The results thereof are shown in Table 2.

The corrosion resistance of the end surface of the core wire was evaluated as follows. A test piece with a length of 40 mm was produced in the same manner as described above. A salt spray test was performed in a state where the end surface of the test piece was exposed. An aqueous solution of 5-mass % sodium chloride was used as liquid in the salt spray test as described above. The testing temperature was set to 35° C. (±2° C.). The testing time was set to 96 hours. Thereafter, corrosion products that did not adhere to the test piece were removed through ultrasonic washing. Then, the reduction of area of the core wire was obtained as follows. The reduction of area (%) was obtained using "{(area A0−area A1)/area A0}×100". The area A0 refers to the area of a longitudinal section of the core wire extending from the end surface of the test piece before the salt spray test to a position located 1 mm therefrom. The area Al refers to the area of a longitudinal section of the core wire between the end surface of the test piece after the salt spray test and the position located 1 mm from the end surface of the test piece before the salt spray test. A "longitudinal section" refers to a cross-section extending along the longitudinal direction of the Al base wire. In this example, the longitudinal section refers to a cross-section passing through the center of the core wire.

A test piece where the reduction of area was less than 2% was evaluated as "5", a test piece where the reduction of area was 2% or more and less than 10% was evaluated as "4", a test piece where the reduction of area was 10% or more and less than 20% was evaluated as "3", a test piece where the reduction of area was 20% or more and less than 50% was evaluated as "2", and a test piece where the reduction of area was 50% or more was evaluated as "1". The results thereof are shown in Table 2.

Workability

The workability of the Al base wire was evaluated through bending processing and checking the surface state of the outer peripheral surface of the Al base wire. In this example, bending processing was performed by helically winding an Al base wire four times around a SUS wire with a diameter of 0.5 mm. The presence or absence of cracks in the coating layer of the Al base wire and peeling was observed using an optical microscope. A test piece where no crack and peeling occurred was evaluated as "5", a test piece where no peeling occurred and a crack occurred in a portion thereof was evaluated as "3", and a test piece where peeling occurred in a portion thereof was evaluated as "1". The results thereof are shown in Table 2.

TABLE 1

| | Coating Layer | | | | | | | | | | |
|---|---|---|---|---|---|---|---|---|---|---|---|
| | | | Second layer | | | | | | | | |
| | First layer | | | | | | | Size of | Third layer | | Ratio of |
| Sample No. | Composition | Thickness D1 (μm) | Current density A/dm$^2$ | Ratio of ion concentrations Sn/Zn | Composition | Thickness D2 (μm) | Zn content (atomic %) | second phase (μm) | Composition | Thickness D3 (μm) | thick-nesses D2/D1 |
| 1 | Ni | 0.2 | 1 | 2.3 | Zn—Sn | 3 | 20 | 0.20 | Sn | 1.9 | 15 |
| 2 | Ni | 0.2 | 1 | 2.3 | Zn—Sn | 3 | 20 | 0.25 | Sn | 7.4 | 15 |
| 3 | Ni | 0.2 | 2 | 2.3 | Zn—Sn | 3 | 35 | 0.22 | Sn | 1.9 | 15 |
| 4 | Ni | 0.2 | 2 | 2.3 | Zn—Sn | 3 | 35 | 0.24 | Sn | 7.4 | 15 |
| 5 | Ni | 0.2 | 4 | 2.3 | Zn—Sn | 3 | 45 | 0.34 | Sn | 1.9 | 15 |
| 6 | Ni | 0.2 | 4 | 2.3 | Zn—Sn | 3 | 45 | 0.36 | Sn | 7.4 | 15 |
| 7 | Ni | 0.5 | 1 | 2.3 | Zn—Sn | 3 | 20 | 0.23 | Sn | 7.1 | 6 |
| 8 | Ni | 0.5 | 2 | 2.3 | Zn—Sn | 3 | 35 | 0.23 | Sn | 7.1 | 6 |
| 9 | Ni | 0.5 | 4 | 2.3 | Zn—Sn | 3 | 45 | 0.34 | Sn | 7.1 | 6 |
| 10 | Ni | 0.2 | 1 | 2.3 | Zn—Sn | 1 | 20 | 0.21 | Sn | 9.4 | 5 |
| 11 | Ni | 0.2 | 2 | 2.3 | Zn—Sn | 1 | 35 | 0.28 | Sn | 9.4 | 5 |
| 12 | Ni | 0.2 | 3 | 2.3 | Zn—Sn | 1 | 45 | 0.37 | Sn | 9.4 | 5 |
| 13 | Ni | 0.5 | 1 | 2.3 | Zn—Sn | 1 | 20 | 0.25 | Sn | 3.6 | 2 |
| 14 | Ni | 0.5 | 1 | 2.3 | Zn—Sn | 1 | 20 | 0.24 | Sn | 9.2 | 2 |
| 15 | Ni | 0.5 | 2 | 2.3 | Zn—Sn | 1 | 35 | 0.22 | Sn | 3.6 | 2 |
| 16 | Ni | 0.5 | 2 | 2.3 | Zn—Sn | 1 | 35 | 0.28 | Sn | 9.1 | 2 |
| 17 | Ni | 0.5 | 4 | 2.3 | Zn—Sn | 1 | 45 | 0.31 | Sn | 3.6 | 2 |
| 18 | Ni | 0.5 | 4 | 2.3 | Zn—Sn | 1 | 45 | 0.33 | Sn | 9.1 | 2 |
| 19 | Ni | 0.2 | 0.5 | 2.3 | Zn—Sn | 3 | 10 | 0.23 | Sn | 7.2 | 15 |
| 20 | Ni | 0.2 | 6 | 1.5 | Zn—Sn | 3 | 65 | 0.52 | Sn | 7.2 | 15 |
| 21 | Sn | 5.1 | — | — | — | — | — | — | — | — | — |
| 22 | Ni | 0.5 | — | — | Sn | 4.6 | — | — | — | — | — |

TABLE 2

| | Corrosion Resistance | | |
|---|---|---|---|
| Sample No. | Peripheral surface | End surface | Workability |
| 1 | 5 | 5 | 5 |
| 2 | 5 | 5 | 5 |
| 3 | 5 | 5 | 5 |
| 4 | 5 | 5 | 5 |
| 5 | 5 | 5 | 5 |
| 6 | 5 | 5 | 5 |
| 7 | 5 | 5 | 3 |
| 8 | 5 | 5 | 3 |
| 9 | 5 | 5 | 3 |
| 10 | 5 | 5 | 5 |
| 11 | 5 | 5 | 5 |
| 12 | 5 | 5 | 5 |
| 13 | 3 | 2 | 3 |
| 14 | 5 | 2 | 3 |
| 15 | 3 | 4 | 3 |
| 16 | 5 | 3 | 3 |
| 17 | 3 | 4 | 3 |
| 18 | 5 | 3 | 3 |
| 19 | 3 | 1 | 3 |
| 20 | 5 | 5 | 1 |
| 21 | 3 | 2 | 1 |
| 22 | 1 | 1 | 3 |

It is found that, as shown in Table 2, the core wires of the Al base wires of Sample No. 1 to Sample No. 18 had higher corrosion resistance, and those Al base wires had higher workability compared to those of Sample No. 19 to Sample No. 22. Specifically, the core wires of the Al base wires of Sample No. 1 to Sample No. 12 had higher corrosion resistance compared to those of Sample No. 13 to Sample No. 18. In particular, Sample No. 1 to Sample No. 6 and Sample No. 10 to Sample No. 12 had higher workability compared to Sample No. 7 to Sample No. 9 and Sample No. 13 to Sample No. 18.

Figure 5:
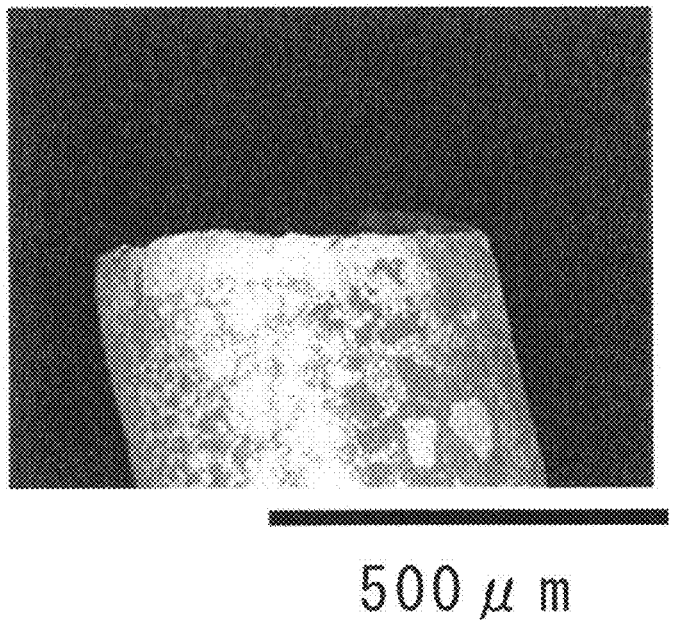
FIG. 5 is a microphotograph showing an outer peripheral surface of an end portion of the aluminum base wire of Sample No. 6.
Figure 6:
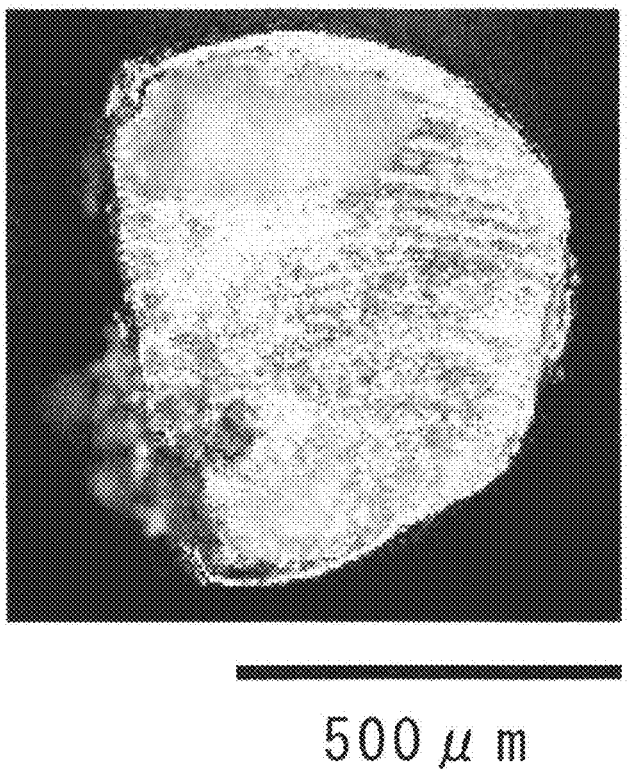
FIG. 6 is a microphotograph showing an end surface of the aluminum base wire of Sample No. 6.
Figure 8:
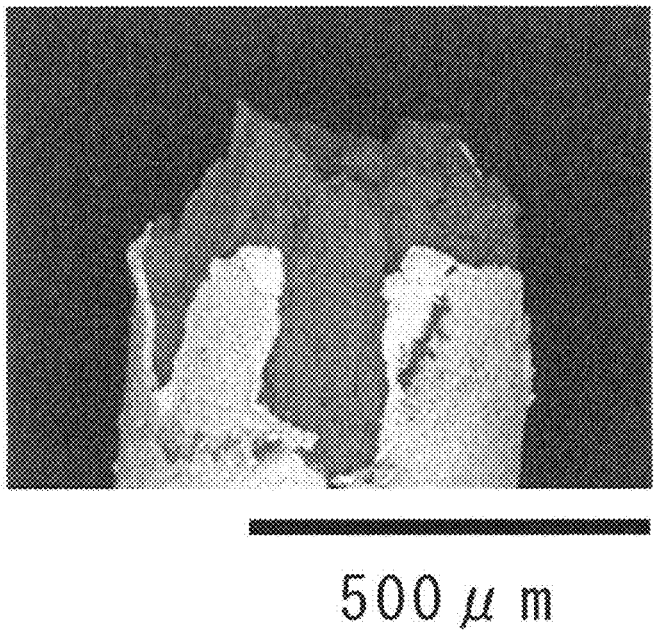
FIG. 8 is a microphotograph showing an outer peripheral surface of an end portion of an aluminum base wire of Sample No. 19.
Figure 9:
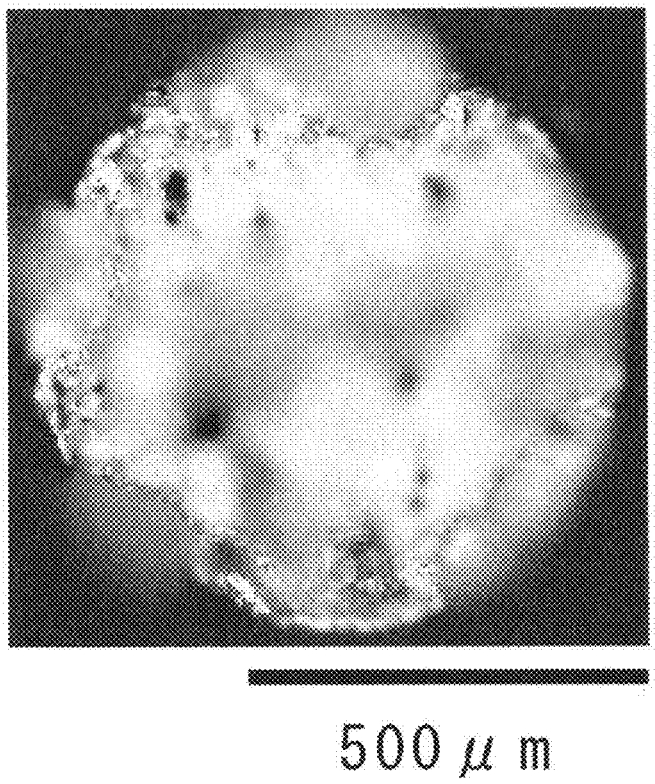
FIG. 9 is a microphotograph showing an end surface of the aluminum base wire of Sample No. 19.

FIGS. 5 and 6 representatively show microphotographs of an outer peripheral surface and an end surface of the Al base wire of Sample No. 6. On the other hand, FIGS. 8 and 9 show microphotographs of an outer peripheral surface and an end surface of the Al base wire of Sample No. 19. The microphotograph of the outer peripheral surface of each sample was a direct observation image. The microphotograph of the end surface of each sample was a backscattered electron image.

Based on FIGS. 5 and 6, it is understood that the core wire of the Al base wire of Sample No. 6 had high corrosion resistance. This is because, as shown in FIG. 5, the outer peripheral surface of the core wire of Sample No. 6 was covered with the coating layer and was not exposed from the coating layer. Also, this is because, as shown in FIG. 6, the end surface of the core wire of Sample No. 6 was in focus over substantially the entire end surface, and a recessed portion was not substantially formed. That is, the core wire of Sample No. 6 was not substantially corroded.

On the other hand, based on FIGS. 8 and 9, it is understood that the core wire of the Al base wire of Sample No. 19 had poor corrosion resistance. As shown in FIG. 8, the coating layer was peeled off from the outer peripheral surface of the core wire of Sample No. 19, and the outer peripheral surface was exposed. Also, this is because, as shown in FIG. 9, the end surface of the core wire of Sample No. 19 had multiple out-of-focus portions, and multiple recessed portions were formed. That is, the core wire of Sample No. 19 was corroded over a wide range.

Figure 7:
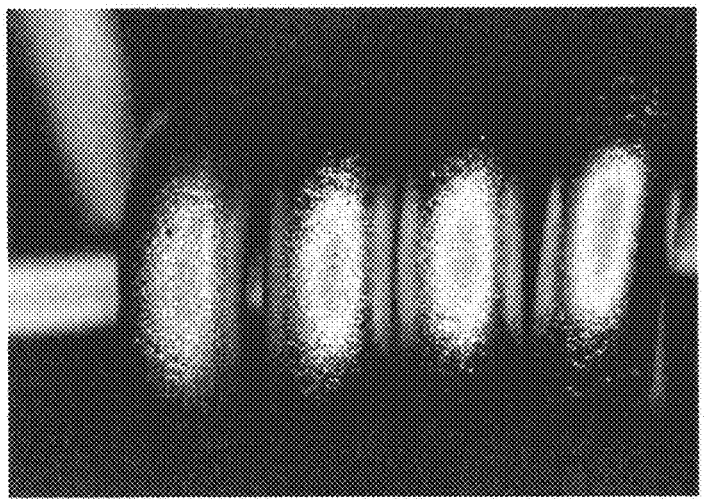
FIG. 7 is a microphotograph showing an outer peripheral surface of the aluminum base wire of Sample No. 6 in bending processing.

FIG. 7 representatively shows a microphotograph of the Al base wire of Sample No. 6 wound around the SUS wire. A member extending in the left-right direction of the page surface of FIG. 7 at the center in the up-down direction of the page surface is the SUS wire.

Based on FIG. 7, it is understood that the Al base wire of Sample No. 6 had high workability. This is because, as shown in FIG. 7, substantially no crack occurred on the outer peripheral surface of the coating layer in the Al base wire of Sample No. 6. On the other hand, although not shown, multiple cracks occurred on the outer peripheral surfaces of the coating layers in the Al base wires of Samples No. 20 and No. 21 whose workability is poor. Specifically, cracks and the like, which extended along the axial direction of the Al base wire that was helically wound, that is, in the longitudinal direction of the SUS line, occurred.

The present invention is defined by the terms of the claims, but not limited to the above description, and is intended to include any modifications within the meaning and scope equivalent to the terms of the claims.

LIST OF REFERENCE NUMERALS

1 Aluminum base wire, Al base wire
2 Core wire
3 Base layer
4 Coating layer
41 First layer
42 Second layer
420 Dispersion structure
421 First phase
422 Second phase
43 Third layer
5 Corrosion product

The invention claimed is:

1. An aluminum base wire comprising:
a core wire made of pure aluminum or an aluminum alloy; and
a coating layer provided on an outer periphery of the core wire,
wherein the coating layer includes
a first layer provided on the outer periphery of the core wire,
a second layer provided on an outer periphery of the first layer, and
a third layer provided on an outer periphery of the second layer,
the first layer is composed of at least one metal selected from the group consisting of nickel, iron, cobalt, chromium, copper, silver, and alloys of these elements,
the second layer is composed of metals that include zinc and tin,
the third layer is composed of at least one metal selected from the group consisting of tin and tin alloys that contain substantially no zinc, and
a zinc content in the second layer is 15 atomic % or more and 60 atomic % or less.

2. The aluminum base wire according to claim 1,
wherein a structure of the second layer has a dispersion structure in which second phases, which contain zinc as a main component, are dispersed in a first phase, which contains tin as a main component, and
the second phase has a size of 0.01 μm or more and 1 μm or less.

3. The aluminum base wire according to claim 1,
wherein a ratio D2/D1 between a thickness D1 of the first layer and a thickness D2 of the second layer is 5 or more.

4. The aluminum base wire according to claim 1,
wherein the first layer has a thickness D1 of 0.05 μm or more and 1 μm or less.

5. The aluminum base wire according to claim 1,
wherein the second layer has a thickness D2 of 0.5 μm or more.

6. The aluminum base wire according to claim 1,
wherein the third layer has a thickness D3 of 1.5 μm or more.

7. The aluminum base wire according to claim 1,
wherein the core wire has a diameter of 0.01 mm or more and 2 mm or less.

8. The aluminum base wire according to claim 1, further comprising
a base layer provided between the core wire and the coating layer,
wherein the base layer contains zinc as a main component.

* * * * *